US007472727B1

(12) United States Patent
Sherrard

(10) Patent No.: US 7,472,727 B1
(45) Date of Patent: Jan. 6, 2009

(54) FUNNEL FOR SANDBAGS

(76) Inventor: Ryan N. Sherrard, 6416 Crews Lake Hills Loop W., Lakeland, FL (US) 33813-3865

( * ) Notice: Subject to any disclaimer, the term of this patent is extended or adjusted under 35 U.S.C. 154(b) by 95 days.

(21) Appl. No.: 11/545,618

(22) Filed: Oct. 9, 2006

(51) Int. Cl.
*B65B 1/04* (2006.01)
*B65B 67/04* (2006.01)

(52) U.S. Cl. ..... 141/316; 141/10; 141/315; 141/337; 141/340; 248/101; 248/173

(58) Field of Classification Search ..... 141/10, 141/114, 331–345, 314–317; 248/94, 97–101, 248/173
See application file for complete search history.

(56) References Cited

U.S. PATENT DOCUMENTS

| | | | | | |
|---|---|---|---|---|---|
| 861,007 | A | * | 7/1907 | Wilhelm | 141/312 |
| 1,414,575 | A | * | 5/1922 | McCart | 248/97 |
| 1,455,536 | A | * | 5/1923 | Lebherz | 248/94 |
| 1,994,890 | A | * | 3/1935 | Cook | 248/97 |
| 2,100,501 | A | * | 11/1937 | Bennett | 248/101 |
| 2,783,010 | A | * | 2/1957 | Ferguson | 248/94 |
| 3,771,752 | A | * | 11/1973 | Meeh | 248/98 |
| 4,273,167 | A | * | 6/1981 | Stillwell | 141/314 |
| 4,312,531 | A | | 1/1982 | Cross | |
| 4,889,300 | A | * | 12/1989 | Gibson et al. | 248/97 |
| 5,048,778 | A | * | 9/1991 | Wright | 248/98 |
| 5,871,037 | A | * | 2/1999 | Feldt | 141/391 |
| 5,884,878 | A | | 3/1999 | Eckhardt | |
| 5,893,260 | A | | 4/1999 | McKenna | |
| 6,047,748 | A | | 4/2000 | Rooker | |
| 6,085,647 | A | * | 7/2000 | Burow | 100/295 |
| 6,109,570 | A | | 8/2000 | Heistand | |
| 6,116,549 | A | * | 9/2000 | Santa Cruz et al. | 248/97 |
| 6,155,522 | A | * | 12/2000 | Anderson | 248/99 |
| 6,676,092 | B2 | * | 1/2004 | Tsai | 248/97 |
| 6,932,126 | B1 | * | 8/2005 | Spagnolo | 141/316 |
| 7,284,732 | B1 | * | 10/2007 | Lopa | 248/99 |

* cited by examiner

*Primary Examiner*—Timothy L Maust

(57) ABSTRACT

A stand to which a sandbag can be easily and quickly, yet securely, attached and which includes a funnel portion that directs sand into the attached sandbag. The stand includes legs that are foldable for storage and a clip system for quickly and securely attaching and detaching sandbags to the funnel portion.

1 Claim, 1 Drawing Sheet

FUNNEL FOR SANDBAGS

TECHNICAL FIELD OF THE INVENTION

The present invention relates to the general art of fluent material handling, and to the particular field of aids to manual filling of containers for fluent material.

BACKGROUND OF THE INVENTION

Sandbagging is used in flood control, temporary construction and military applications. It remains the most cost-effective and efficient method of flood control and military construction to date. Millions of sandbags are used for flood control when river banks overflow. In military installations, such as those encountered in Vietnam, up to thirty million sandbags a month were utilized. All of these were filled by hand. The small size of the sandbag (seventeen by ten by four inches), makes its carrying and positioning a one man operation. When sandbags are used as a single unit of many, the size allows great flexibility for building earth works. The use of sandbags is comparable to that of brick. It can be used in a variety of positions and numbers to create unlimited and differing results. Once the sandbags are set, they can be easily removed and repositioned as required.

Until the 1960's, the bags were made of burlap, folded, and sewn on two sides, with a drawstring in the third side. By the 1970's, a woven polypropylene replaced the burlap, and technical innovation in bags came to a halt. Currently, bags are woven, folded, and sewn at a remote facility, after which they are shipped to the site and filled. In most instances, the sandbags are filled strictly through manual labor. A person fills them with a few shovels full of soil or sand, pulls and ties the drawstring, and tosses the completed bag into a pile to be picked up at a later time.

Sandbags are often the only flood control method available to reinforce or raise the height of dikes, berms, or levees used to protect property from flood water damage. The typical method used to fill sandbags is that one person holds the sandbag while a second person shovels sand or other granular material into the bag. When the bag is filled and the open end of the bag closed, the sandbag is ready for use. This method requires two people to fill a single sandbag at a time when there are generally insufficient personnel available to complete the work required to prevent or minimize flood damage. Additionally, as much as fifty percent of the sand thrown at a sandbag misses the bag, and falls back to the ground. The sand that misses the bag results in wasted effort. Thus, it takes a longer period of time to fill a sandbag and more energy is expended per sandbag. Consequently, fewer sandbags are filled in a given time period.

SUMMARY OF THE INVENTION

The above-discussed disadvantages of the prior art are overcome by a stand to which a sandbag can be easily and quickly, yet securely, attached and which includes a funnel portion that directs sand into the attached sandbag. The stand includes legs that are foldable for storage and a clip system for quickly and securely attaching and detaching sandbags to the funnel portion.

Using the stand embodying the present invention will permit the quick and easy filling of a sandbag by a single worker with little or no waste. The stand is collapsible for convenient storage and rapid deployment when necessary. A sandbag is securely held in place on the stand so accidental spilling is not likely to occur.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 3:
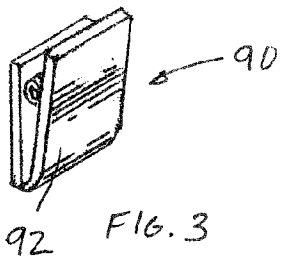
FIG. 3 is a perspective view of a clip used to attach a sandbag to the stand shown in FIG. 1.

Referring to the figures, it can be understood that the present invention is embodied in a stand unit 10 used to fill a sandbag 12 which is to be filled with sand for use. A body 14 which has a first section 16 which is cylindrical in shape and which includes a first end 18 which is a bottom end when the body is in use. First end 18 has an outer dimension 20 and a second end 22 which is a top end of the first section when the body is in use. A bore 24 extends from first end 18 to second end 22. A longitudinal axis 26 extends between the first end of the first section and the second end of the first section. First section 16 further includes an inner surface 28 adjacent to the bore and an outer surface 30.

Body 12 further includes a second section 40 which is in the shape of a truncated cone and which includes a first end 42 which is a bottom end and which is attached to the second end of the first section. First end 42 of the second section has an outer dimension 44 which is equal to outer dimension 20 of the first section adjacent to the second end of the first section. Second section 40 further includes a second end 46 which is a top end when the body is in use and which has an outer dimension 48 that is greater than outer dimension 44 of the first end of the second section.

A bore 50 extends from first end 42 of the second section to second end 46 of the second section. Bore 50 is aligned with bore 24 of the first section and defines a continuous bore 54 through body 12 from second end 46 of the second section to first end 18 of the first section. A longitudinal axis 56 extends between first end 42 and second end 46 of the second section and which is co-linear with longitudinal axis 26 of the first section. Second section 40 further includes an inner surface 56 located adjacent to bore 50 of the second section and an outer surface 58.

A plurality of legs, such as leg 60, are attached to the outer surface of the first section of the body. The legs are identical to each other, and each leg includes a first portion 62 which has a first end 64 which is a top end when in use and which is pivotally attached to outer surface 30 of first section 12 of the body and a second end 66 which is a distal end when in use.

Each leg further includes a second portion 70 which has a first end 72 which is a top end when in use and which is pivotally attached to the distal end of the first portion of the leg and a second end 74 which is a distal end when in use. A foot 76 is attached to the distal end. A pivot connection 80 pivotally connects distal end 66 of first portion 62 of the leg to top end 72 of the second portion of the leg.

Figure 2:
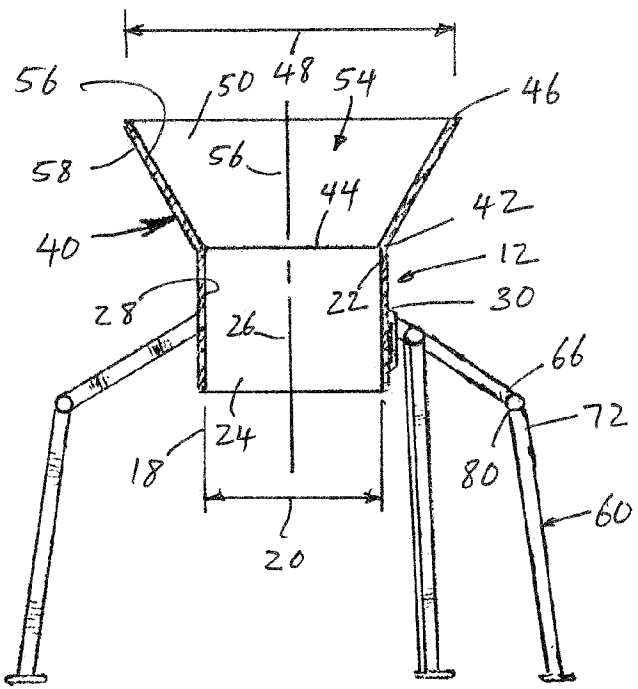
FIG. 2 is a view taken along line A-A of FIG. 1.
Figure 1:
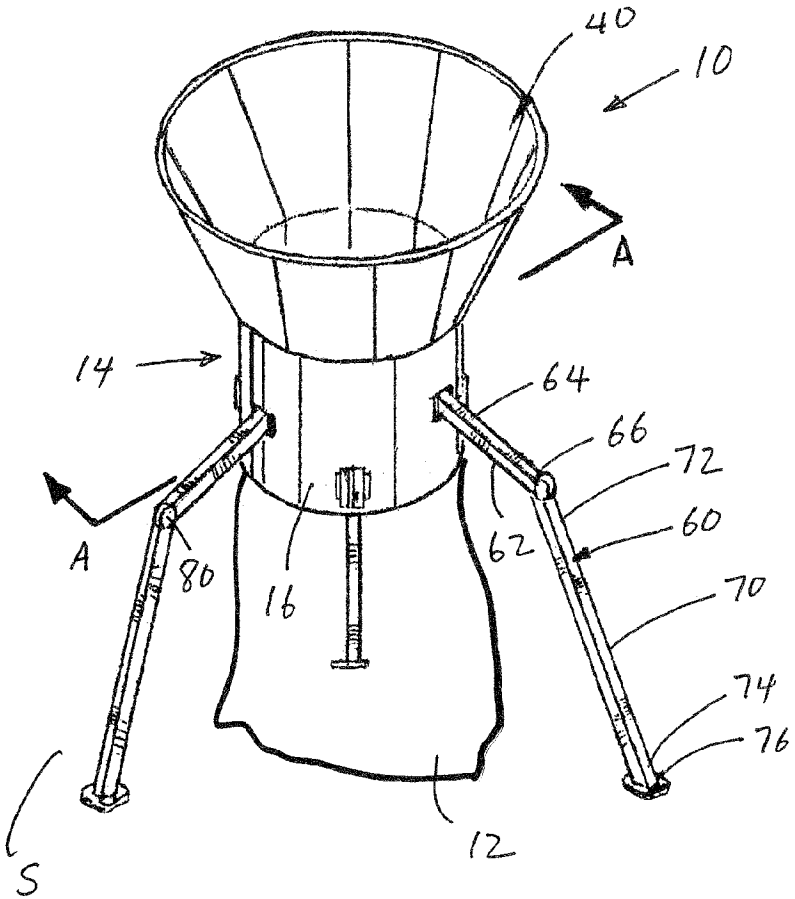
FIG. 1 is a perspective view of a stand for supporting and filling a sandbag embodying the present invention.

The legs are movable between a stored condition with the first portion located adjacent to the body and the second portion located adjacent to the first portion and a deployed condition, such as shown in FIGS. 1 and 2, with the first portion extending away from the body and the second portion extending at an angle to the first portion towards a supporting surface, such as the ground S, with the foot on the supporting surface. The legs support the body above the supporting surface when in use.

The stand unit further includes a plurality of clips, such as clip 90 shown in FIG. 3. Each clip includes a hairpin-shaped body 92 and is attached to first end 18 of the first section of the body during use and attaches sandbag 12 to the body at a location and in a position to accept sand that has been poured into the body through the second end 46 of the second section of the body and which is funneled down from the large end 46 to the end 18 that is small enough to fit into the sandbag. The large end of the body makes pouring or shoveling sand into the body easy and spill free, while the small end of the body makes connection to a sandbag quick, easy and secure. Once the sandbag is full, it is easily and quickly removed from the body by removing the clips and then removing the sandbag from beneath the body. A new sandbag is quickly and easily attached to the body by simply positioning the new sandbag beneath the body and clipping it to the body using clips 90.

One form of the device can include a lever-operated clipping unit which replaces clips 90 and which attaches the sandbag to the body using a lever-operated system. While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A stand unit used to fill a sandbag comprising:

A) a sandbag which is to be filled with sand for use;

B) a body having (1) a first section which is cylindrical in shape and which includes (a) a first end which is a bottom end when the body is in use, the first end of the first section having an outer dimension, (b) a second end which is a top end of the first section when the body is in use, (c) a bore which extends from the first end of the first section to the second end of the first section, (d) a longitudinal axis which extends between the first end of the first section and the second end of the first section, (e) an inner surface adjacent to the bore, and (f) an outer surface, (2) a second section which is in the shape of a truncated cone and which includes (a) a first end which is a bottom end of the second section when the body is in use and which is attached to the second end of the first section, the first end of the second section having an outer dimension which is equal to the outer dimension of the first section adjacent to the second end of the first section, (b) a second end which is a top end when the body is in use, the second end of the second section having an outer dimension that is greater than the outer dimension of the first end of the second section, (c) a bore which extends from the first end of the second section to the second end of the second section, the bore of the second section being aligned with the bore of the first section to define a continuous bore through the body from the second end of the second section to the first end of the first section, (d) a longitudinal axis which extends between the first end of the second section and the second end of the second section and which is co-linear with the longitudinal axis of the first section, (e) an inner surface located adjacent to the bore of the second section, and (f) an outer surface;

C) a plurality of legs attached to the outer surface of the first section of the body, each leg of the plurality of legs including (1) a first portion having (a) a first end which is a top end when in use and which is pivotally attached to the outer surface of the first section of the body, and (b) a second end which is a distal end when in use, (2) a second portion having (a) a first end which is a top end when in use and which is pivotally attached to the distal end of the first portion of the leg, (b) a second end which is a distal end when in use, and (c) a foot on the distal end, and (3) a pivot connection pivotally connecting the distal end of the first portion of the leg to the top end of the second portion of the leg, and (4) the legs being movable between a stored condition with the first portion located adjacent to the body and the second portion located adjacent to the first portion and a deployed condition with the first portion extending away from the body and the second portion extending at an angle to the first portion towards a supporting surface with the foot on the supporting surface, the legs supporting the body above the supporting surface when in use; and D) a plurality of clips, each clip of the plurality of clips including a hairpin-shaped body and which is attached to the first end of the first section of the body during use and which attaches the sandbag to the body.

* * * * *